United States Patent [19]

Boyd

[11] 4,423,876

[45] Jan. 3, 1984

[54] GAME-TOY ANTHROPOMORPHIC (HUMAN-ROBOT-SHAPED) DOMINOES

[76] Inventor: Alvin L. Boyd, P.O. Box 5280, Austin, Tex. 78763

[21] Appl. No.: 342,483

[22] Filed: Jan. 25, 1982

[51] Int. Cl.[3] ..... A63F 9/20

[52] U.S. Cl. ..... 273/294; 46/25

[58] Field of Search ..... 273/153 P, 294, 1 GF, 273/156; 46/131, 22, 25, 151, 1 N; 434/300, 302

[56] References Cited

U.S. PATENT DOCUMENTS

| | | | |
|---|---|---|---|
| 1,330,780 | 2/1920 | Bonte | 46/22 UX |
| 1,648,199 | 11/1927 | Sargent | 46/22 UX |
| 4,225,139 | 9/1980 | Cosmopulos | 273/294 |

*Primary Examiner*—Harland S. Skogquist

[57] ABSTRACT

This game-toy, a domino-man, is a human-robot-shaped figure to be used either in playing dominoes by formal game rules, or in construction, stacking and knock-over play usually done with traditional domino pieces. The domino-dot number equivalents are printed in incised dots on the back flat surface of the figure for domino games. The front of the figure has large hands, in gauntlets, to enhance the pushover, or agressive, play action. Feet, helmet and shoulders of the figure are designed to fit together in a loose, interlocking fashion to permit easy arrangement in domino play, and for stacking construction. The figure will push over easily when hit by another, permitting the usual arrangement of knock-over lines of the figure, just as traditional domino tiles are used in play. The domino-man figure can be produced in any size, any color, of any solidified material.

1 Claim, 6 Drawing Figures

GAME-TOY ANTHROPOMORPHIC (HUMAN-ROBOT-SHAPED) DOMINOES

BACKGROUND OF THE INVENTION

I. Field of the Invention

This invention is in the specific field of dominoes, and is a new and improved game-toy whereby a variation of the traditional domino dot-pattern is applied to the back flat surface of a human-robot-shaped figure. The new domino figure can be used to play domino games in the usual manner, plus the creative stacking, construction arrangements and pushover play enjoyed by children.

II. Description of the Prior Art

Dominoes, being an ancient game of skill, originating in the Orient, further developed in Europe in the 18th century, and named after the domino (a black clack), are traditionally used by all age groups as game pieces, and frequently used as building blocks for stacking into shapes or as lined-up units that, when placed approximately one-half to three-fourths inch apart, knock each other down when one is started (pushed over toward line up), so that all are eventually pushed over.

Traditional dominoes have evolved to a usual shape (proportion) of one-unit wide×two-units tall×$\frac{1}{4}$-to $\frac{1}{2}$-units thick (averaging 1-inch wide×2-inches tall×$\frac{1}{4}$-to$\frac{1}{2}$-inch thick), made of wood, plastic or often of bone, ivory or similar hard substances, plain on one side, imprinted on other side with a series of dots in double panels.

This invention is an improvement over the traditional domino in that a head (in helmet) and feet (in boots) have been added, to create a top and bottom, plus large hands (in gauntlets) to enhance the pushing characteristic of dominoes when used a a toy, stacked or arranged in a row, in the pushover-ripple effect commonly enjoyed by children. These additions create the anthropomorphism indicated in the name. A robot look is achieved by the strong rectangular shape used for the armor-plate front and back side areas. The back side will be imprinted with number-equivalents in dots traditionally used on dominoes. The robot look is further created by the armor-plate front side, large gauntleted hands and feet in boots.

This invention also uses dots to represent number values or equivalents, as traditional dominoes do, but in a different graphic pattern arrangement. Each domino will be produced with two hexagonal patterns of 19 dots (five rows of dots: top row with 3 dots; 2nd row with 4 dots; center row with 5; 4th with 4; bottom row with 3 dots), all slightly incised (depressed) into the surface of the upper and lower halves of the two back panels. Certain dot-depressions in the hexagonal patterns will be imprinted with ink or paint to indicate the number value or equivalent, as traditional dominoes are printed, as follows (first number goes in top panel/-second number goes in bottom panel) on the two-panel backs of each piece: 9/9, 8/9, 7/9, 6/9, 5/9, 4/9, 3/9, 2/9, 1/9, 0/9, 8/8, 7/8, 6/8, 5/8, 4/8, 3/8, 2/8, 1/8, 0/8, 7/7, 6/7, 5/7, 4/7, 3/7, 2/7, 1/7, 0/7, 6/6, 5/6, 4/6, 3/6, 2/6, 1/6, 0/6, 5/5, 4/5, 3/5, 2/5, 1/5, 0/5, 4/4, 3/4, 2/4, 1/4, 0/4, 3/3, 2/3, 1/3, 0/3, 2/2, 1/2, 0/2, 1/1, 0/1, 0/0. Zero (blank) values will have no imprinted ink or paint in the depressed dots. As in traditional dominoes, there will be twenty-eight pieces (domino figures) per full set of double-sixes and fifty-five pieces per full set of double-nines.

Most domino games can be played with these impoved pieces, using traditional game rules usually followed for games such as: All Fives (Muggins); All Threes; Block and Draw; Forty-two; Matador; Sniff; Straight; Threes and Fives; Whist.

The Transformation of the old traditional domino form to human-robot-shape increases the number of visual effects that new pieces will create when physically stacked, lined-up, and arranged for non-game, structural or push-over play.

The new, improved domino figures in this invention can be produced in any size, smaller or larger than usual 1"×2"×$\frac{1}{4}$"-$\frac{1}{2}$", depending on play emphasis preferred for their use: formal games by usual domino rules; coordination and play therapy for child's education or physical development; simple play activity (construction-destruction) and recreational stacking, lining-up, arranging and knocking down.

SUMMARY OF THE INVENTION

An object of the present invention is to provide a new variety of form for domino game pieces, especially for young players, from the plain traditional rectangular domino shape to a new human-robot-shape to which they can still easily relate as a domino game piece.

Another object of the invention is to provide, especially for children, a more pleasant graphic representation of number value-equivalents through the use of the dots in a pattern arrangement different from that used in traditional dominoes.

A further object of the invention is to give greater visual variety and choices of physical arrangements of the domino figures when used for play in stacking, lining-up and arranging for constructive, knockdown or pushover sequences. Helmet (head) and boot (feet) sizes and their placement on the new, improved pieces will allow many variations of placement and imaginative arrangements in physical play.

Actual, physical design of the domino figures allow for the following arrangement variations:

1. Each piece standing on its feet.
2. Each piece standing on its head.
3. Each piece lying on either side.
4. Each piece lying on its back or front.
5. Multiple pieces, all standing on feet, with other pieces standing on their shoulders, and repeating layers upwards. This arrangement can also be placed in a closed circular pattern, with each added layer creating a higher cylindrical pattern.
6. Multiple pieces, first layer all standing on feet (or heads), second layer stacked standing on opposite ends, heads (or feet), and so on, upwards, each layer alternately standing on feet or heads. Closed cylindrical pattern can also be arranged with this method.
7. Many other variations-combinations are possible, limited only by the imagination of the player, just as traditionally-shaped dominoes are employed in games and play.

Feet and head on figures will not create any problems when pieces are placed flat on their backs, for arrangements and placement used in traditional domino games, such as Straight.

A further object of the invention is to encourage creation of new games and uses through production of 28- and 55- piece sets in different colors, limited to one color per set. For example: a 28-piece set of black figures with white dots could be the enemy in a game against a 28-piece set of white figures with black dots; or 100 red sets with white dots, plus 50 yellow sets with black dots, motion-photographed from above on a white background, could be used to form a company trademark or commercial message when arranged in-line for a ripple push-over sequence.

DESCRIPTION OF THE PREFERRED EMBODIMENTS

Figure 1:
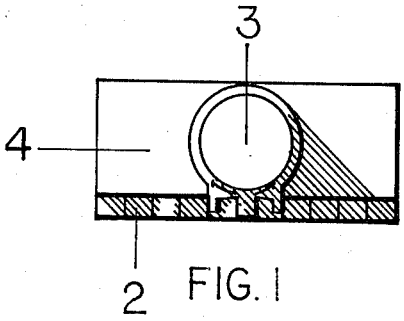
FIG. 1 is a top view of the figure. The front of the figure is at the bottom and the back is at the top of the drawing.

FIG. 1 is a top view of figure showing two of four critical flat areas which are top of helmeted head (3), and shoulders (4). Other critical areas that establish balance stability and stacking variability are boot bottoms (10) and armor skirt bottom (9) both shown on FIG. 5. FIG. 1 also shows top ends of gauntleted hands (2).

Figure 2:
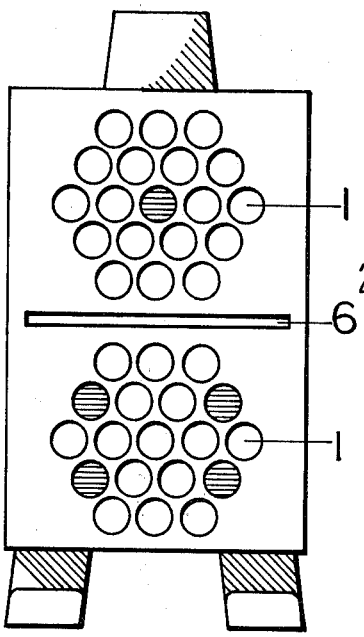
FIG. 2 is the back side showing the incised dot arrangements with 1/4 value shown in black dots.

FIG. 2 is a back side elevation view of figure showing double hexagonal arrangements of 19 incised dots each (1) that will carry selected dot-imprints of number equivalent sequences for all figures. Number shown on this figure is 1/4 (one dot in top half of back panel is imprinted, four dots in bottom half of back panel are imprinted). Also shown on this figure is an incised central dividing line (6) which separates top and bottom hexagonal dot patterns, similar to dividing line on traditional dominoes. This line (6) will be imprinted with ink or paint on all figures, including the 0/0 piece, although the 0/0 piece will have no imprinted dots (see FIG. 6, Blank).

Figure 3:
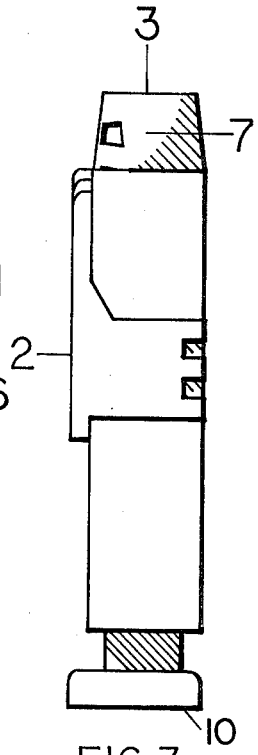
FIG. 3 is the left side showing incised lines of gauntleted hands.

FIG. 3 is a left side elevation view (both sides being identical except that the right side elements of figure face other direction) that shows front flat surface of gauntleted hands (2), flat top surface of helmeted head (3), and flat bottom of bootted feet (10). The left and right sides of helmet (7) can be used for symbol imprint (such as capital letter A if trade name of figure is Astrominoes or Astromen, etc.)

Figure 4:
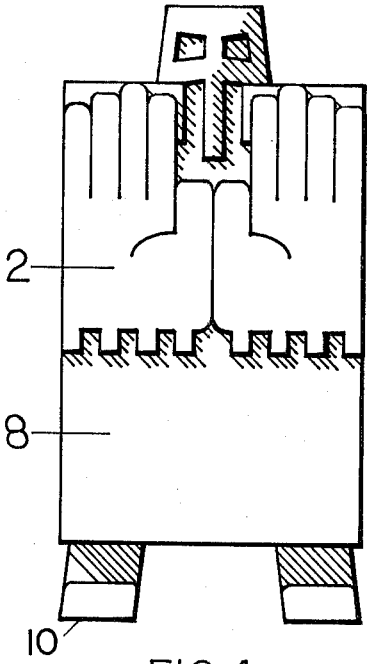
FIG. 4 is the front side showing large gauntleted hands, helmet details.

FIG. 4 is a front side elevation view showing detail of flat fronts of gauntleted hands (2), and lower armor surface (8) which can be used for imprint or commercial trade name or graphic logotype (Astrominoes or Astromen, for instance).

Figure 5:
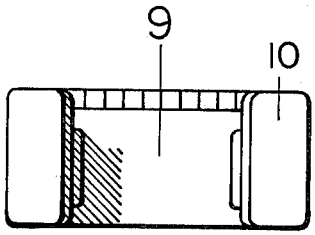
FIG. 5 is the bottom view. The front of the figure is at the top, and the back is at the bottom of the drawing.

FIG. 5 is a bottom view showing 2 of 4 critical flat areas, bottoms of booted feet (10) and bottom of armor (skirt) area (9). The 4 flat areas (helmet top, shoulders, boot soles and armor skirt bottom) are critical to stacking, standing and other arrangement stability. Armored skirt bottom (9) could also be used for producer's identification imprint, or other production data.

Figure 6:
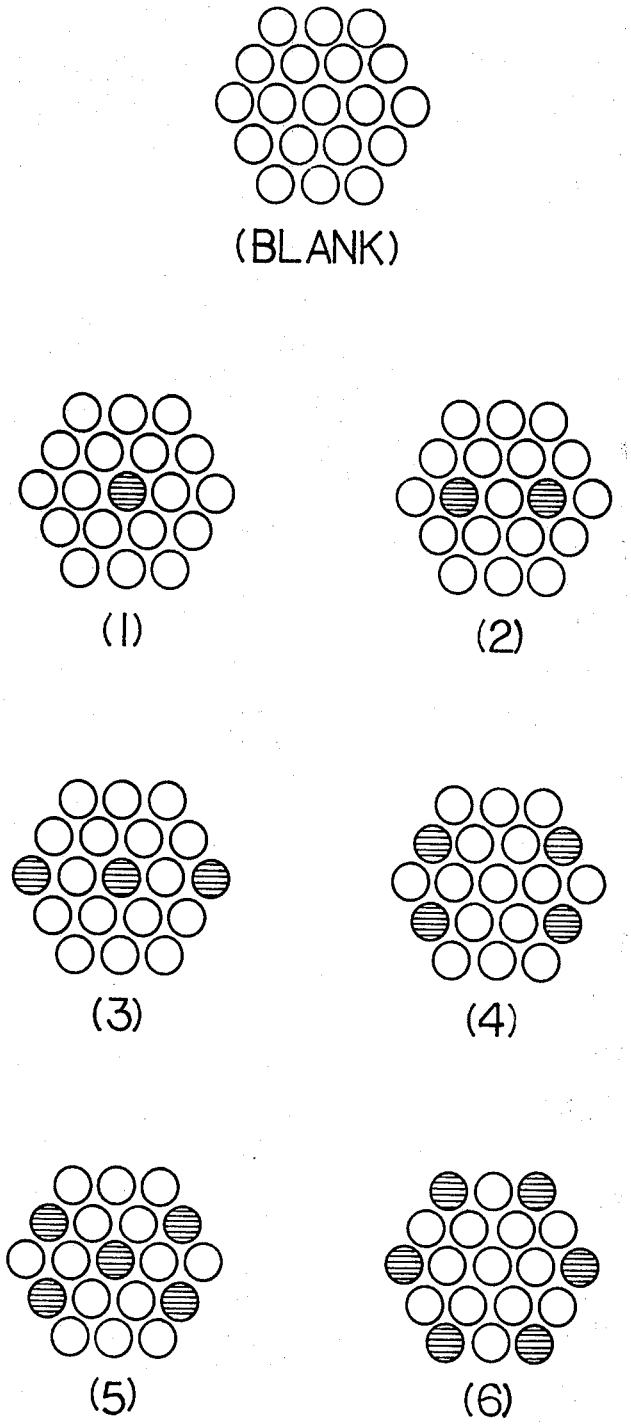
FIG. 6 shows the hexagonal incised dot pattern that will carry the number-equivalents of the dot patterns, 1 through 6, plus the blank shown at top of the drawing.

FIG. 6 is a view of pattern arrangement that will be used to imprint dots in 19 incised-dot hexagon patterns, for all pieces. All blank (zero number) pieces will not be imprinted with ink or paint in any of the dots, but will have only unimprinted 19-dot patterns in the hexagon design. All areas calling for numerical equivalent of one will be imprinted in ink or paint is shown at (1). All twos, as shown at (2). All threes, as shown at (3). All fours, as shown at (4). All fives, as shown at (5). All sixes, as shown at (6).

Note that FIG. 2, back vertical elevation view of figure, shows 1/4 dot pattern imprinted in hexagon design. Dot equilavents of the usual number combinations will be imprinted on the backs, in traditional domino dot sequence (first number imprints on top panel half/second number imprints on bottom panel half).

Having described my invention, and what I desire to secure by Letters Patent, I claim:

1. A new and improved set of game-toy domino figures that: has added to each piece a head-in-helmet at the top, legs-in-armor and feet-in-boots at the bottom, and hands-in-gauntlets on the front side, to achieve the appearance of a human-robot-shaped domino figure with a large flat area on the back which is divided into two equal panels of a top area and bottom area, with each panel having an incised (depressed) hexagonal pattern of 19 dots (five rows of dots, with top row of 3 dots, 2nd row of 4 dots, center row of 5 dots, 4th row of 4 dots, bottom row of 3 dots), with certain patterns of those dots selected to be imprinted in ink or paint in numerical equivalents in the following sequence (first number imprints in top panel half/second number imprints in bottom panel): 9/9, 8/9, 7/9, 6/9, 5/9, 4/9, 3/9, 2/9, 1/9, 0/9, 8/8, 7/8, 6/8, 5/8, 4/8, 3/8, 2/8, 1/8, 0/8, 7/7, 6/7, 5/7, 4/7, 3/7, 2/7, 1/7, 0/7, 6/6, 5/6, 4/6, 3/6, 2/6, 1/6, 0/6, 5/5, 4/5, 3/5, 2/5, 1/5, 0/5, 4/4, 3/4, 2/4, 1/4, 0/4, 3/3, 2/3, 1/3, 0/3, 2/2, 1/2, 0/2, 1/1, 0/1, 0/0, so that they can be used, just as traditional dominoes are used, to play established-rule domino games such as All Five (Muggins), All Threes, Block and Draw, Forth-Two, Matador, Sniff, Straight, Threes and Fives, Whist, etc.; will be produced in traditional 28- and 55-piece sets of double-sixes and double-nines from any color or any liquid casting medium such as metal, plastic or epoxy, or shaped or carved from other hard media such as wood, bone, stone or ivory; can be stacked, arranged, or lined-up in many variations and positions because of the exact design and placement of the flat helmet top, shoulder and boot-bottom surfaces, which provide stable positioning and loose interlocking, even upside-down; will retain the overall dimensions of traditional dominoes in a one-unit wide × two-units high × $\frac{1}{4}$- to $\frac{1}{2}$-units thick; are well-balanced in all positions, yet will easily tip over when hit or pushed by another piece to achieve the push-over ripple effect such as traditional dominoes do; has an overall physical appearance of a space-age robot with human shape; has extra-large gauntleted (gloved) hands to enhance the pushing characteristic and the physically aggressive visual personality of the design.

* * * * *